US009615717B2

(12) United States Patent
Zhu

(10) Patent No.: US 9,615,717 B2
(45) Date of Patent: Apr. 11, 2017

(54) SPIN-DRYABLE MOP

(71) Applicant: Jiaxing Jackson Travel Products Co., Ltd., Jiaxing (CN)

(72) Inventor: Xuelin Zhu, Jiaxing (CN)

(73) Assignee: Jiaxing Jackson Travel Products Co., Ltd., Jiaxing (CN)

( * ) Notice: Subject to any disclaimer, the term of this patent is extended or adjusted under 35 U.S.C. 154(b) by 295 days.

(21) Appl. No.: 14/388,538

(22) PCT Filed: Jul. 18, 2014

(86) PCT No.: PCT/CN2014/082551
§ 371 (c)(1),
(2) Date: Sep. 26, 2014

(87) PCT Pub. No.: WO2015/010577
PCT Pub. Date: Jan. 29, 2015

(65) Prior Publication Data

US 2015/0282685 A1 Oct. 8, 2015

(30) Foreign Application Priority Data

Jul. 25, 2013 (CN) ..... 2013 2 0446415 U

(51) Int. Cl.
*A47L 13/14* (2006.01)
*A47L 13/142* (2006.01)
(Continued)

(52) U.S. Cl.
CPC ..... *A47L 13/142* (2013.01); *A47L 13/14* (2013.01); *A47L 13/146* (2013.01); *A47L 13/20* (2013.01)

(58) Field of Classification Search
CPC ..... A47L 13/14; A47L 13/142; A47L 13/144; A47L 13/146
(Continued)

(56) References Cited

U.S. PATENT DOCUMENTS 8,220,101 B2 * 7/2012 Chen ..... A47L 13/20 15/119.1
8,316,502 B2 * 11/2012 Shao ..... A47L 13/14 15/119.1
(Continued)

FOREIGN PATENT DOCUMENTS

CH 287161 * 11/1952
CN 201879632 U 6/2011
(Continued)

OTHER PUBLICATIONS

International Search Report of the international application PCT/CN2014/082551.

*Primary Examiner* — Mark Spisich
(74) *Attorney, Agent, or Firm* — Wang Law Firm, Inc.

(57) ABSTRACT

In a spin-dryable mop, a handle includes upper and lower tubes. A spinning mechanism movably connects the upper tube to the lower tube. The spinning mechanism rotates the upper tube on the lower tube when the upper tube moves axially on the lower tube. A locking mechanism includes a sleeve and a quick-release. The sleeve is secured to the upper tube and located at a place where the upper tube is connected to the lower tube. The sleeve includes an opening. The quick-release is connected to the sleeve in the opening. The quick-release includes a cam extending through the opening to press the lower tube to keep the upper tube in position on the lower tube. A spin-drying mechanism includes a net for movably receiving the lower tube and a shelter for rotationally receiving the net. A mop head is connected to the lower tube.

29 Claims, 27 Drawing Sheets

(51) Int. Cl.
*A47L 13/146* (2006.01)
*A47L 13/20* (2006.01)

(58) Field of Classification Search
USPC ..... 15/116.1, 116.2, 119.1, 119.2, 120.1, 15/120.2
See application file for complete search history.

(56) References Cited

U.S. PATENT DOCUMENTS

| | | | | |
|---|---|---|---|---|
| 8,522,387 | B2 * | 9/2013 | Chen | A47L 13/20 15/119.1 |
| 2006/0021171 | A1 * | 2/2006 | Niccolai | A47L 13/142 15/120.1 |
| 2011/0247163 | A1 * | 10/2011 | Chen | A47L 13/142 15/228 |

FOREIGN PATENT DOCUMENTS

| | | | |
|---|---|---|---|
| CN | 102144910 | A | 8/2011 |
| CN | 202553838 | U | 11/2012 |
| CN | 103082962 | A | 5/2013 |
| CN | 103417168 | A | 12/2013 |
| CN | 203407998 | U | 1/2014 |
| FR | 848688 | * | 11/1939 |
| KR | 10-1007943 | B1 | 1/2011 |

* cited by examiner

SPIN-DRYABLE MOP

BACKGROUND OF INVENTION

1. Field of Invention

The present invention relates to a mop and, more particularly, to a spin-dryable mop.

2. Related Prior Art

A spin-dryable mop is different from a conventional mop in that a spin-dryable mop can be spin-dried according to the centrifugal effect that is used in a spin-dryer. A spin-dryable mop can be found in Patent GB235684, "Improvements in and relating to Mops.

Another spin-dryable mop is used with a bucket equipped with a spin-drying mechanism. Such a combination can be found in Chinese Patent No. 201220668933.4. However, a bucket equipped with a spin-drying mechanism must be produced for every such spin-dryable mop. A lot of resources in labor and materials are consumed, and impose a heavy financial burden on customers.

The present invention is therefore intended to obviate or at least alleviate the problems encountered in prior art.

SUMMARY OF INVENTION

It is the primary objective of the present invention to provide a convenient spin-dryable mop.

To achieve the foregoing objectives, the spin-dryable mop includes a handle, a spinning mechanism, a locking mechanism, a spin-drying mechanism and a mop head. The handle includes an upper tube and a lower tube. The upper tube receives the lower tube. The spinning mechanism movably connects the upper tube to the lower tube. The spinning mechanism rotates the upper tube relative to the lower tube when the upper tube is moved axially relative to the lower tube. The locking mechanism includes a sleeve and a quick-release. The sleeve is secured to the upper tube and located at a place where the upper tube is connected to the lower tube. The sleeve includes an opening. The quick-release is connected to the sleeve in the opening. The quick-release includes a cam extending through the opening to press the lower tube to keep the upper tube in position relative to the lower tube. The spin-drying mechanism includes a shelter and a net. The net movably receives the lower tube, wherein the shelter rotationally receives the net. The mop head is connected to a lower end of the lower tube.

In use, the quick-release of the locking mechanism is used to keep the upper tube in position relative to the lower tube and keep the spin-drying mechanism in position relative to the upper tube. Thus, the spin-dryable mop can be used to mop or washed. To spin-dry the spin-dryable mop, the quick-release of the locking mechanism is operated to allow the upper tube to move relative to the lower tube, and the spin-drying mechanism is moved downwards so that the net completely covers the mop head. A user uses one hand to hold the shelter and the other hand to move the upper tube downwards. The lower tube is rotated because of the spinning mechanism. The mop head is rotated with the net. Then, the upper tube is moved upwards back into the original position. This, process is repeated to cast water from the mop head because of the centrifugal effect. Then, the water travels downwards along the shelter and falls into a bucket, sink or any other proper place.

In another aspect, the spinning mechanism includes a cap, a screw, a driving element and a collar. The cap is inserted in and secured to the upper tube. The screw is secured to a lower face of the cap. The driving element movably receives the screw. The driving element includes a first ratchet at a lower end. The collar is inserted in and secured to the lower tube. The collar includes a cavity. The driving element is inserted in the cavity. The screw extends through the collar. The collar includes a second ratchet corresponding to the first ratchet.

When the upper tube is moved downwards, the screw moves downwards with the driving element. When the first ratchet of the driving element contacts the second ratchet of the collar, the driving element is stopped in the collar. The screw is still moved downwards, and the driving element is turned into rotation from translation. Due to engagement of the first ratchet with the second ratchet, the driving element rotates the collar and therefore the lower tube. The lower tube rotates the mop head and the net to spin-drying.

In another aspect, the spin-dryable mop further includes a cover attached to an upper face of the collar. The height of the cavity is larger than the height of the driving element plus the height of the second ratchet.

When the upper tube is moved upwards again after it is moved downwards, the screw moves the driving element upwards in the collar so that the first ratchet is disengaged from the second ratchet. The driving element continues to move upwards so that an upper end of the driving element contacts a lower end of the collar and that the driving element is stopped. Now, the screw is still moved upwards, and the driving element is turned into rotation from translation. The driving element is rotated in the collar without driving the lower tube because the first ratchet is disengaged from the second ratchet.

In another aspect, the spin-dryable mop further includes a washer located on the screw. The washer is located between the cap and the collar. Thus, the screw does not hit the collar when the upper tube is moved downwards.

In another aspect, the spin-dryable mop further includes a spring located between the cap and the washer. Thus, the spring is used to improve buffer.

In another aspect, the spin-dryable mop further includes a fastener secured to a lower end of the screw and a second washer located on the screw, wherein the second washer is located between the collar and the fastener. Thus, the collar cannot be dropped from a lower end of the screw when the screw is moved upwards.

In another aspect, the sleeve includes a first rib formed on an internal face. The collar includes a second rib corresponding to the first rib, wherein the second rib is made with an external diameter larger than an internal diameter of the first rib.

In another aspect, the collar includes two lugs so that the opening is located between the lugs. The lug includes a first aperture, wherein the quick-release includes a second aperture corresponding to the first aperture. A pin is inserted in the first aperture and the second aperture to pivotally connect the quick-release to the sleeve.

In another aspect, the cam is formed at an end of the quick-release. The quick-release includes a lever formed at another end. The lever is used to facilitate pivoting of the quick-release.

In another aspect, the sleeve includes a cavity. The shelter includes an engaging element inserted in the cavity when the spin-dryable mop is in use. Thus, the shelter of the spin-drying mechanism is engaged with the sleeve when the spin-dryable mop is in use.

In another aspect, the sleeve further includes a groove in communication with the cavity. The engaging element includes an elastic block inserted in the groove when the spin-dryable mop is in use. Thus, the spin-drying mechanism is engaged with the sleeve when the spin-dryable mop is in use.

In another aspect, the spin-dryable mop further includes a bearing and a clip. The shelter includes a cavity for receiving the bearing. The bearing includes an external ring inserted in the cavity and an internal ring extending out of the cavity. The clip is located on the net corresponding to the internal ring of the bearing. The clip is engaged with the internal ring of the bearing. Thus, the shelter and the net are rotatable with each other.

In another aspect, the shelter and the net are in the form of a trumpet including a smaller upper end and a larger lower end. The shelter and the net are hollow from the upper end to the lower end.

In another aspect, each of the shelter and the net includes a grip and a hollow portion. The grip is connected to an upper end of the hollow portion. The hollow portion is used to receive the cleaning unit when spin-drying is conducted. The grip is used to facilitate holding of the spin-dryable mop.

In another aspect, the net includes a plurality of apertures so that water can easily be cast from the mop head.

In another aspect, the mop head includes a second joint and a cleaning unit. The second joint is detachably connected to a lower end of the lower tube. The cleaning unit is connected to the second joint.

In another aspect, the cleaning unit includes cloth.

In another aspect, the mop head includes a connecting unit and a cleaning unit. The connecting unit includes a second joint, a plate and several foldable elements. The second joint is detachably connected to a lower end of the lower tube. The plate is movably connected to the second joint. The foldable elements are pivotally connected to the plate. The foldable elements are evenly located around the plate. The cleaning unit is attached to lower faces of the foldable elements. With the connecting unit, the cleaning unit can be collapsed and inserted in the spin-drying mechanism.

In another aspect, the foldable element is pivotally connected to the plate via a hinge.

In another aspect, the amount of the foldable elements is two.

In another aspect, the foldable element includes a first strip and two second strips. The first strip is pivotally connected to the plate via a hinge. Each of the second strips is pivotally connected to a corresponding edge of the first strip via a hinge.

In another aspect, the spin-dryable mop further includes a pivotal connector. The plate is formed with a first lug pivotally connected to the pivotal connector about a first axis. The second joint is formed with a second lug pivotally connected to the pivotal connector about a second axis extending perpendicular to the first axis. Thus, a universal joint is made between the second joint and the plate so that the plate can be rotated in all directions relative to the second joint.

In another aspect, the amount of the foldable elements is three.

In another aspect, the spin-dryable mop further includes a flexible strip connected to lower faces of the foldable elements. The cleaning unit is connected to a lower face of the flexible strip.

In another aspect, the foldable elements are made of a flexible material. The foldable elements together form a flexible strip. The cleaning unit is connected to a lower face of the flexible strip.

In another aspect, the amount of the foldable elements is five.

In another aspect, the spin-dryable mop further includes a universal joint arranged between the plate and the second joint, and the universal joint includes a pivotal element and a cap. The pivotal element includes a lug and a disc. The plate includes a cavity. The pivotal element is movably inserted in the cavity. The cap includes an aperture. The cap is secured to the plate. The lug extends through the aperture to close the disc in the cavity.

In another aspect, the cleaning unit includes sponge.

The spin-dryable mop of the present invention is advantageous over the prior art. There is no need for a specialized bucket. Any proper bucket can be used to contain clean water for washing the spin-dryable mop or dirty water cast from the spin-dryable mop. This saves a lot of resources in labor and materials. Accordingly, this imposes a lighter financial burden on a customer.

Other objectives, advantages and features of the present invention will be apparent from the following description referring to the attached drawings.

BRIEF DESCRIPTION OF DRAWINGS

The present invention will be described via detailed illustration of four embodiments referring to the drawings wherein.

DETAILED DESCRIPTION OF EMBODIMENTS

Figure 1:
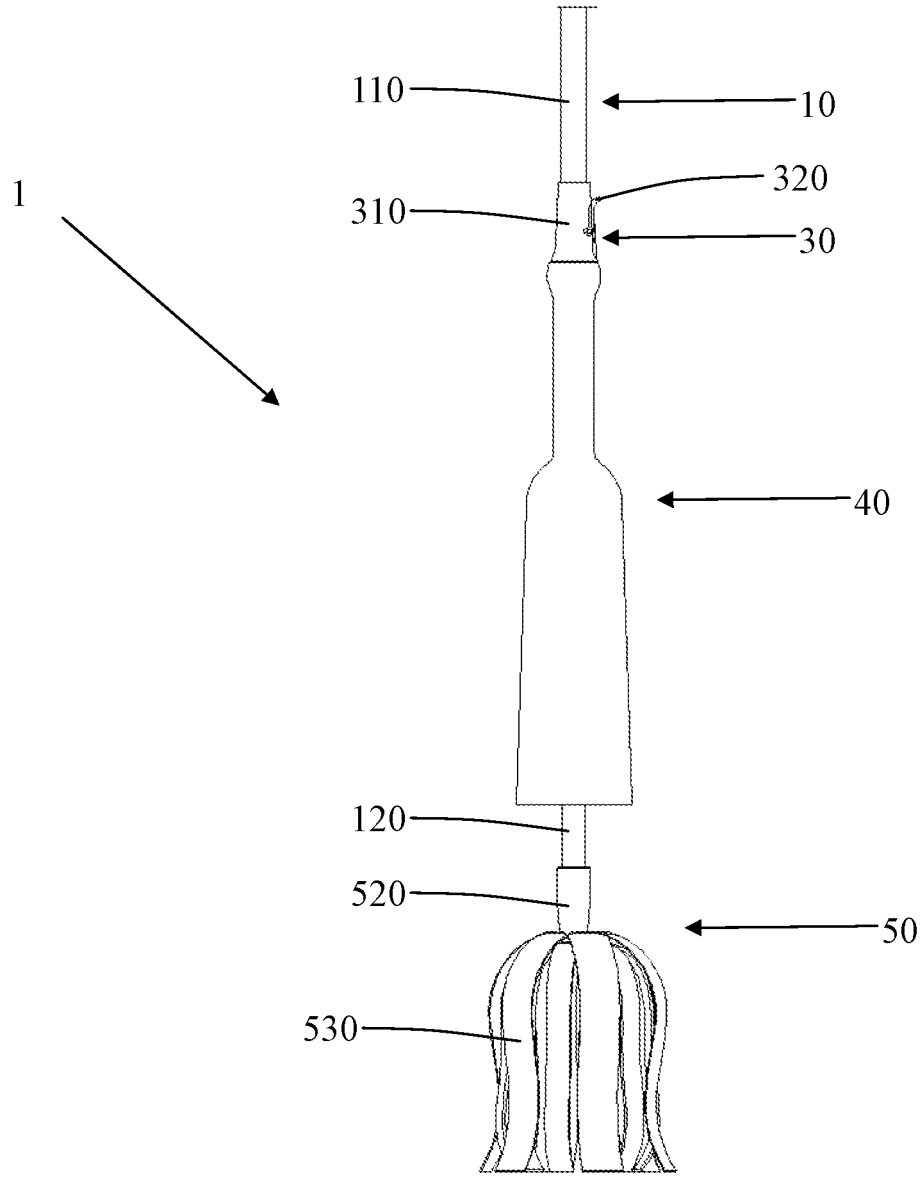
FIG. 1 is a front view of a spin-dryable mop according to the first embodiment of the present invention.

Referring to FIGS. 1 through 4, a spin-dryable mop 1 includes a handle 10, a spinning mechanism 20, a locking mechanism 30, a spin-drying mechanism 40 and a mop head 50 according to a first embodiment of the present invention.

Figure 2:
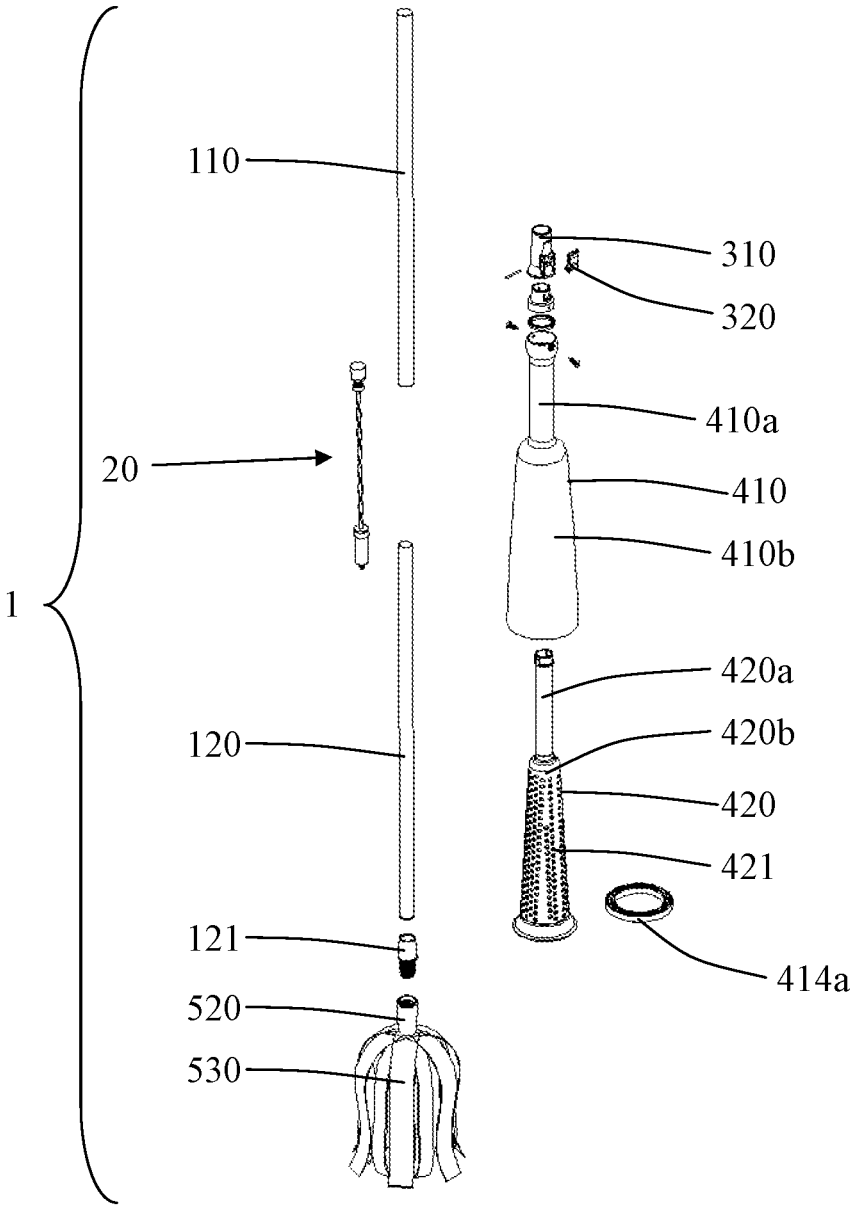
FIG. 2 is an exploded view of the spin-dryable mop shown in FIG. 1.
Figure 3:
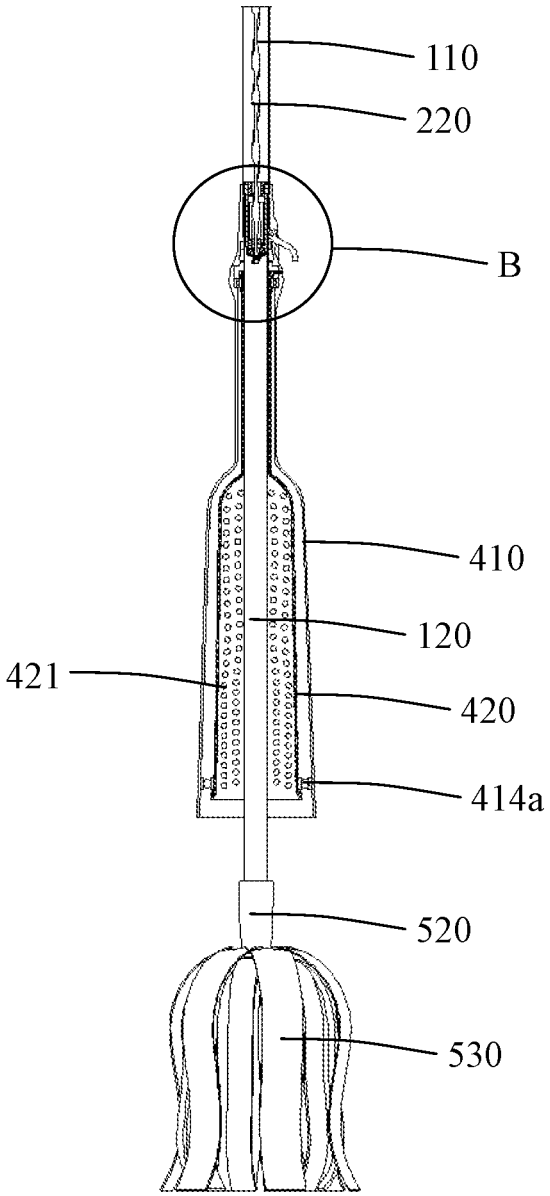
FIG. 3 is a cross-sectional view of the spin-dryable mop shown in FIG. 1.

Referring to FIGS. 2 and 3, the handle 10 includes an upper tube 110 and a lower tube 120. The upper tube 110 receives the lower tube 120. The upper tube 110 is connected to the lower tube 120 via the spinning mechanism 20. The spinning mechanism 20 is axially movable relative to the upper tube 110 and the lower tube 120 to rotate the upper tube 110 relative to the lower tube 120. The lower tube 120 includes a first join 121 at a lower end.

Figure 5:
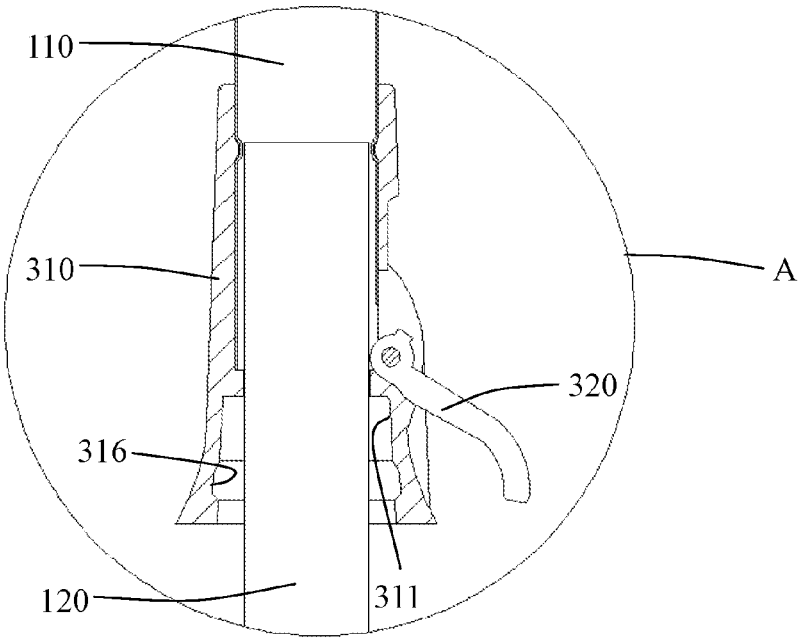
FIG. 5 is a cross-sectional view of a locking mechanism of the spin-dryable mop marked-up with "A" in FIG. 4.
Figure 6:
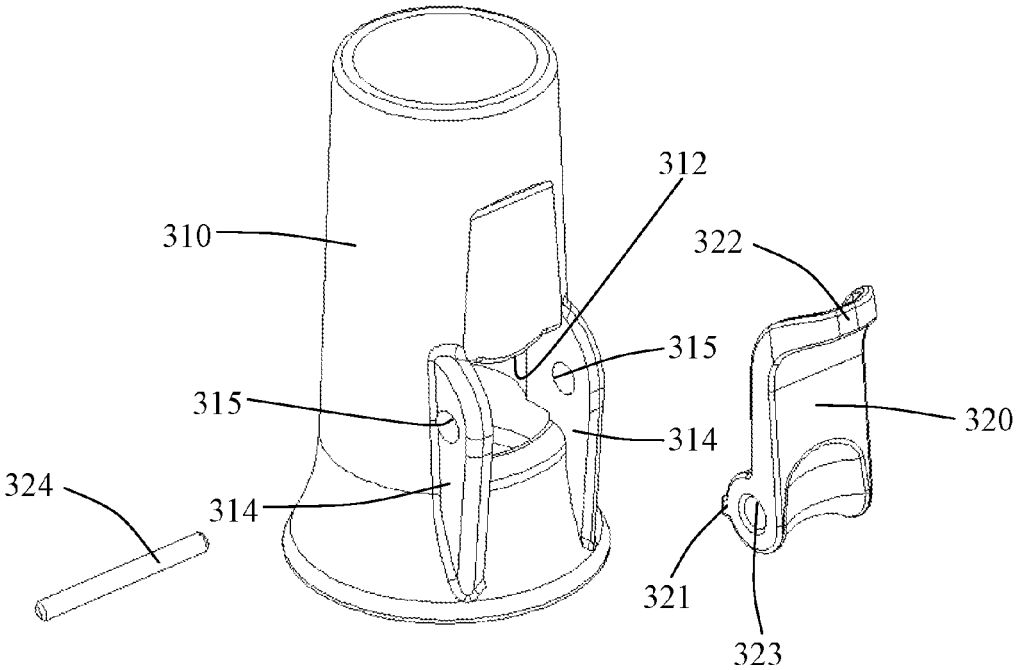
FIG. 6 is an exploded view of the locking mechanism shown in FIG. 5.
Figure 7:
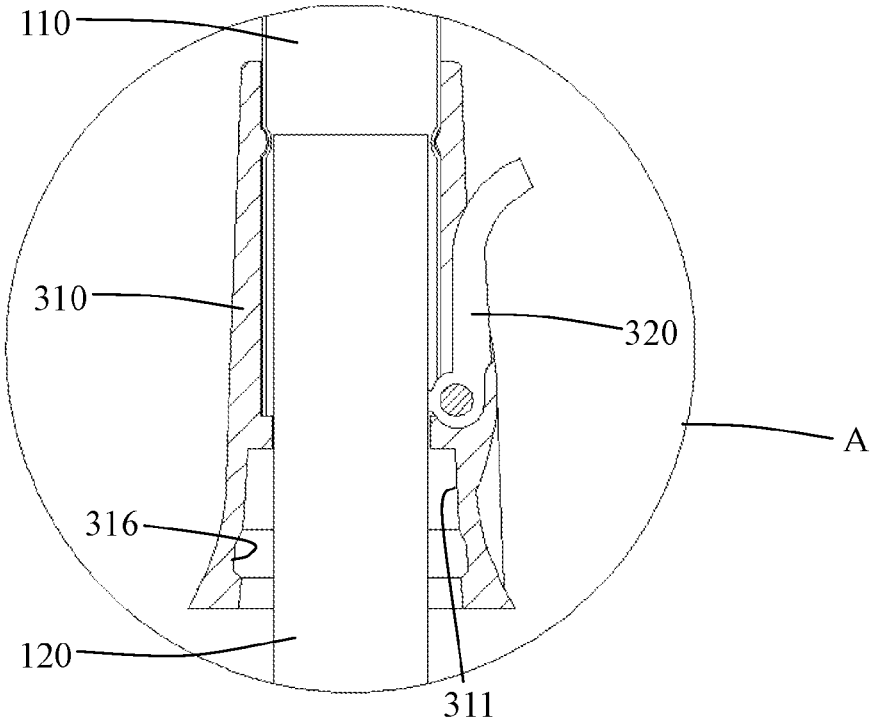
FIG. 7 is a cross-sectional view of the locking mechanism in another position than shown in FIG. 5.

Referring to FIGS. 5 and 6, the locking mechanism 30 includes a sleeve 310 and quick-release 320. The sleeve 310 is located around and secured to the upper tube 110. The sleeve 310 is located in a place where the upper tube 110 is connected to the lower tube 120. The sleeve 310 includes a cavity 311 in the bottom and an opening 312 in the periphery. The quick-release 320 is pivotally connected to the periphery of the sleeve 310, in the opening 312. The quick-release 320 includes a cam 321 formed at a first end and a lever 322 formed at a second end. The lever 322 is used to facilitate pivoting of the cam 321. Referring to FIG. 7, in operation, the cam 321 is located against the lower tube 120 through the opening 312 of the sleeve 310 to avoid movement of the upper tube 110 relative to lower tube 120. That is, the upper tube 110 is kept in position relative to the lower tube 120. The quick-release 320 can be pivoted from the sleeve 311 to disengage the cam 321 of the quick-release 320 from the lower tube 120 to allow the upper tube 110 to move relative to the lower tube 120.

Figure 8:
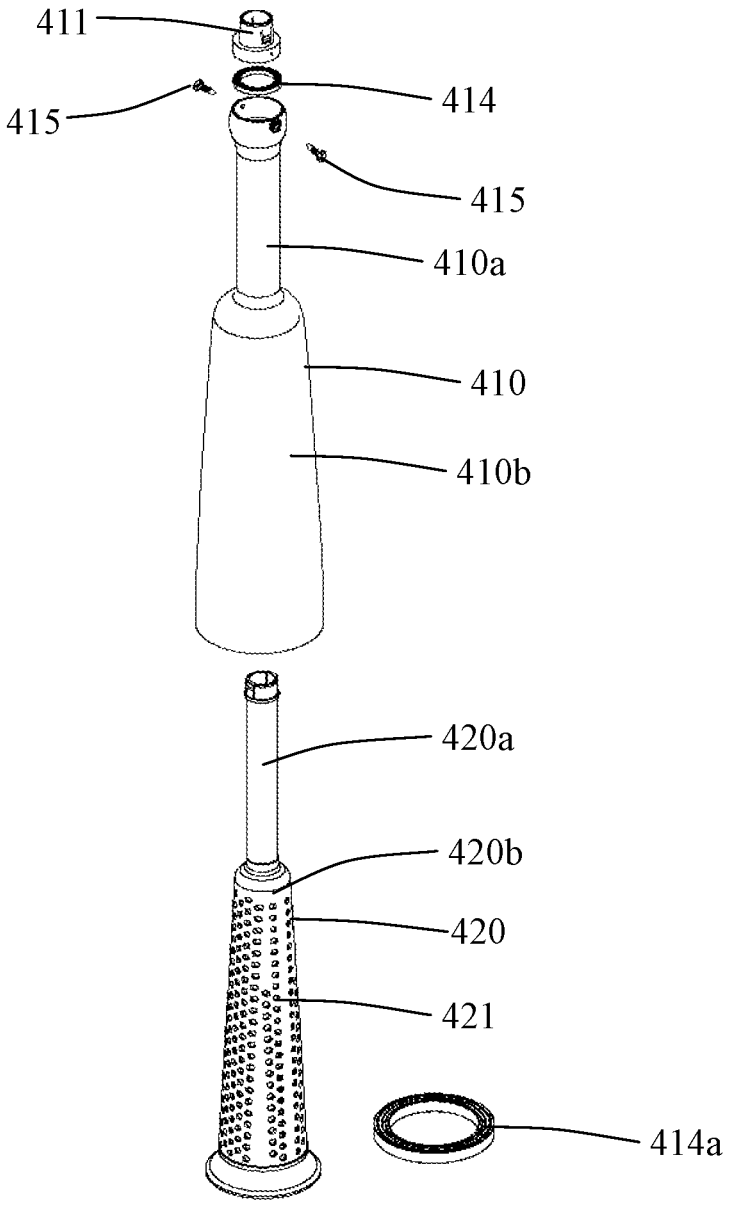
FIG. 8 is an exploded view of a spin-drying mechanism of the spin-dryable mop shown in FIG. 1.
Figure 9:
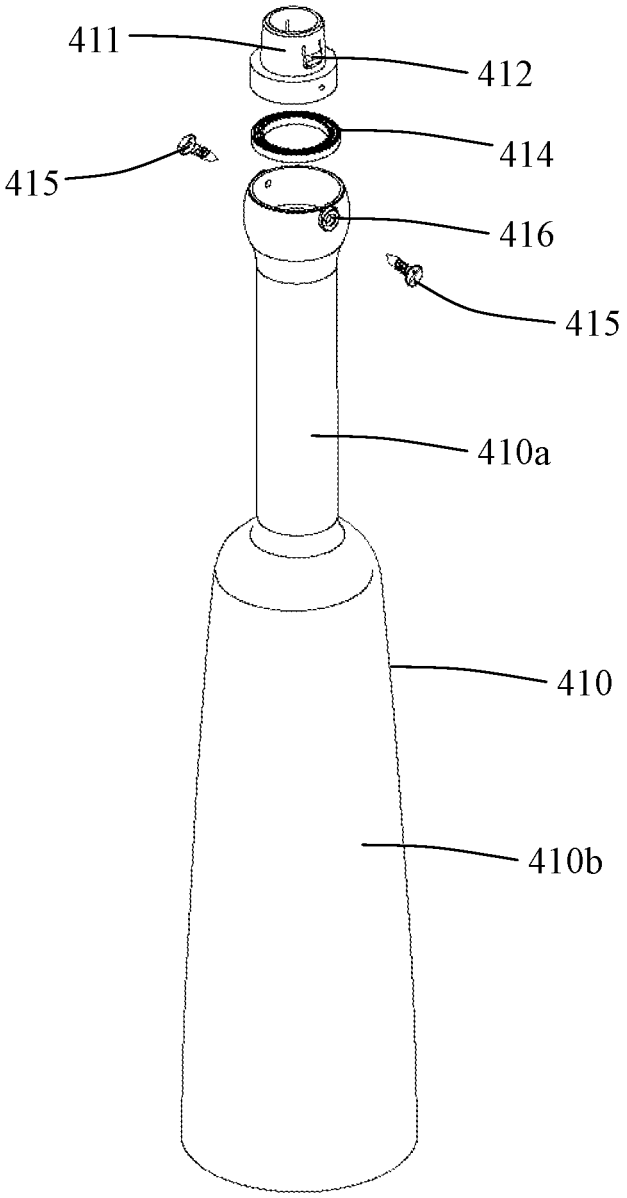
FIG. 9 is another exploded view of the spin-dryable mop shown in FIG. 8.

Referring to FIGS. 8 and 9, the spin-drying mechanism 40 includes a shelter 410 and a net 420. The shelter 410 and the net 420 look like a trumpet formed with a smaller upper end and a larger lower end. The shelter 410 and the net 420 are hollow. The shelter 410 includes a grip 410*a* and a hollow portion 410*b*. The grip 410*a* is connected to an upper end of the hollow portion 410*b*. The net 420 includes a grip 420*a* and a hollow portion 420*b*. The grip 420*a* is connected to an upper end of the hollow portion 420*b*.

Figure 10:
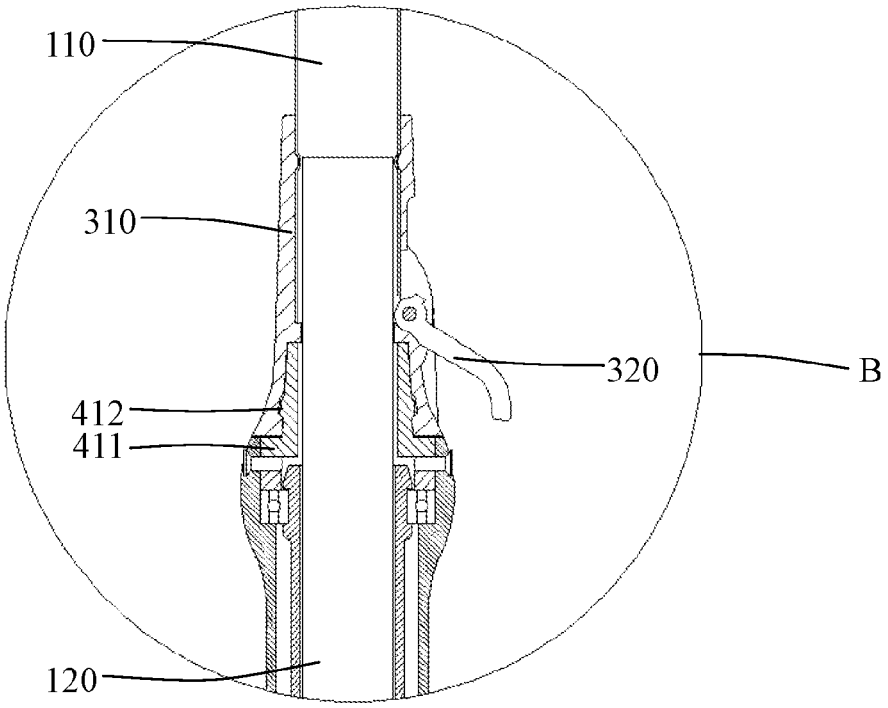
FIG. 10 is a cross-sectional view of a portion of the spin-dryable mop marked-up with "B" shown in FIG. 3.

The net 420 includes a plurality of apertures 421. The net 420 is movably supported on the lower tube 120. The shelter 410 is located around the net 420. The shelter 410 is rotatable relative to the net 420. The shelter 410 includes an engaging element 411 formed at the top. The engaging element 411 includes an elastic block 412 formed on a side. Referring to FIG. 10, in operation, the engaging element 411 is located in the cavity 311 of the sleeve 310, thus keeping the shelter 410 of the spin-drying mechanism 40 in the sleeve 310.

The mop head 50 is connected to a lower end of the lower tube 120.

Figure 11:
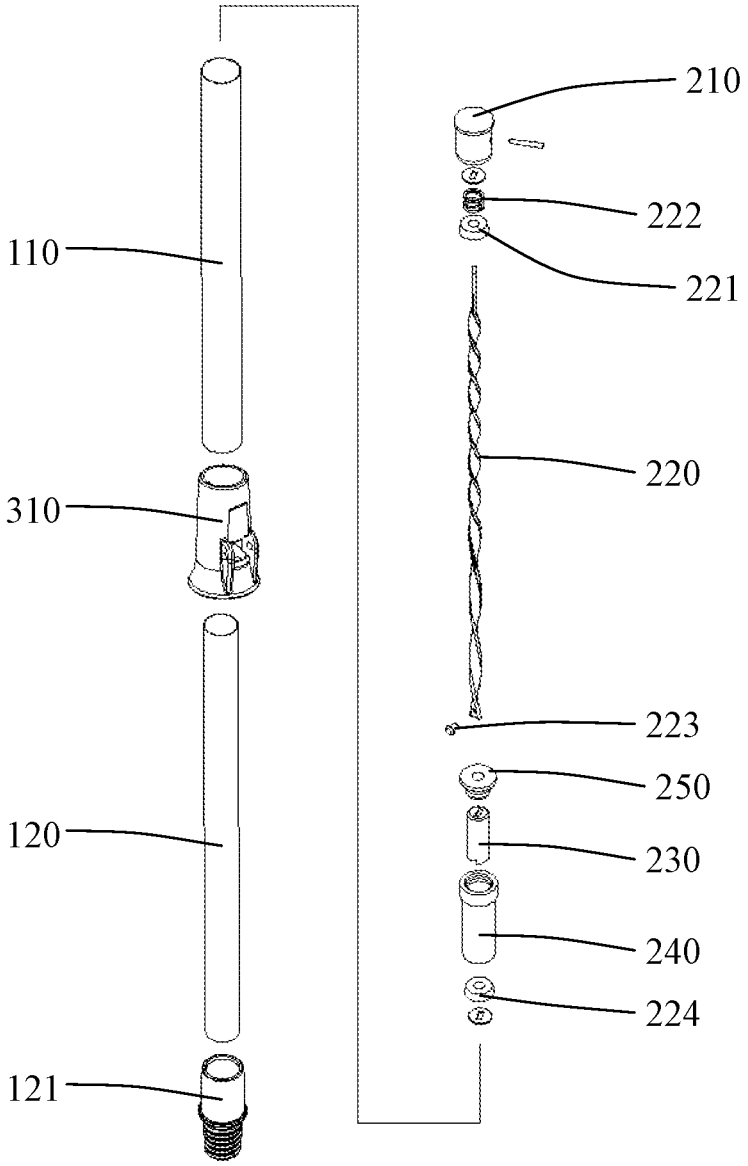
FIG. 11 is an exploded view of a spinning mechanism of the spin-dryable mop shown in FIG. 1
Figure 12:
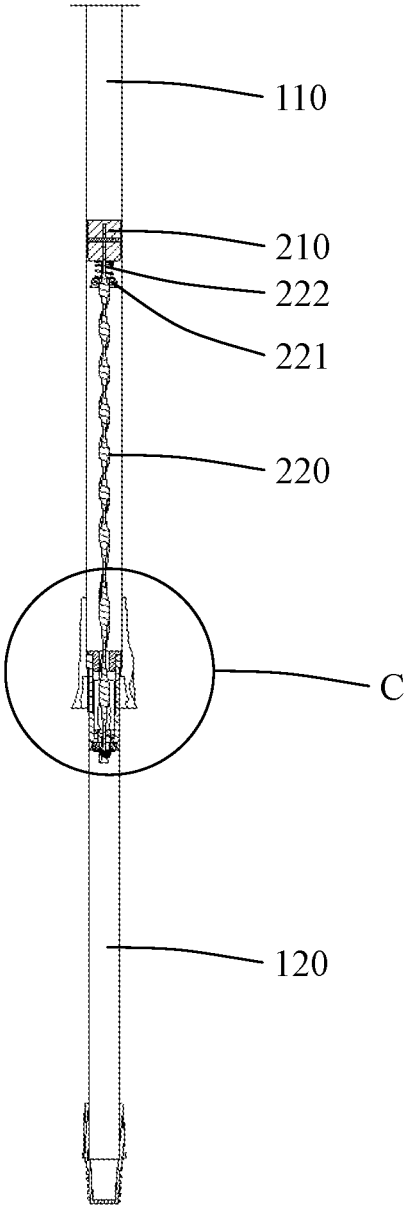
FIG. 12 is a cross-sectional view of the spinning mechanism illustrated in FIG. 11.
Figure 13:
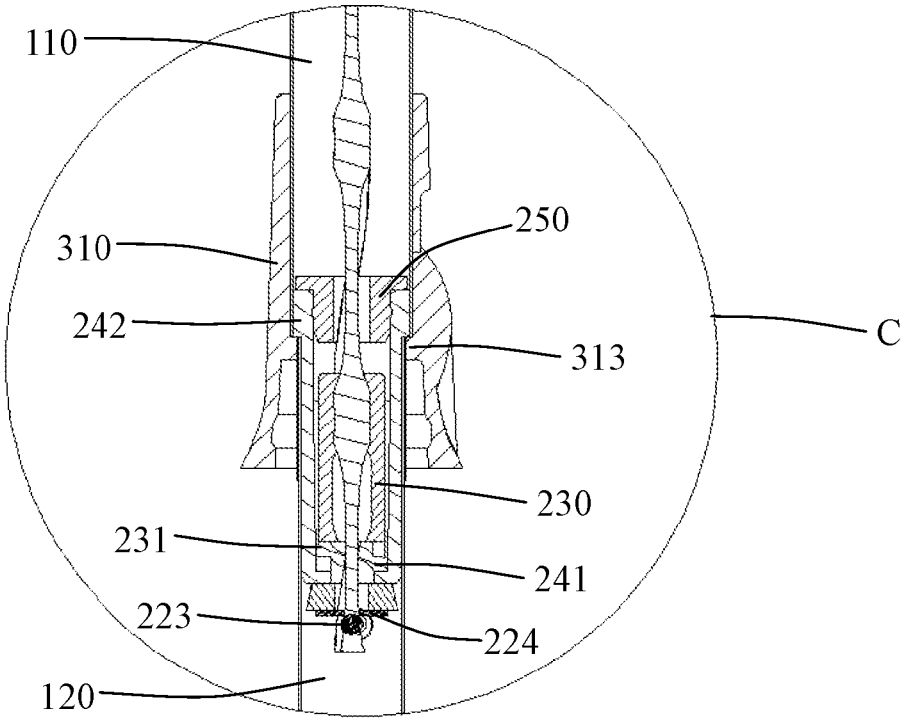
FIG. 13 is a cross-sectional view of a portion of the spin-dryable mop marked-up with "C" in FIG. 12.

Referring to FIGS. 11 and 12, in the handle 10, the spinning mechanism 20 includes a cap 210, a screw 220, a driving element 230 and a collar 240. The cap 210 is inserted in and secured to the upper tube 110. The screw 220 is secured to a lower end of the cap 210. The driving element 230 is movably supported on the screw 220. Referring to FIG. 13, the driving element 230 includes a ratchet 231 at the bottom. The collar 240 is inserted in and secured to the lower tube 120. The collar 240 includes an internal space for receiving the driving element 230. The screw 220 extends through the collar 240. The collar 240 includes a second ratchet 241 formed at the bottom corresponding to the first ratchet 231 of the driving element 230.

Thus, when the upper tube 110 is pressed, the screw 220 moves the driving element 230 downwards. When the first ratchet 231 of the driving element 230 encounters the second ratchet 241 of the collar 240, the first ratchet 231 of the driving element 230 is stopped by and kept in the collar 240. At this moment, the screw 220 is still moved downwards because of a downward force from the upper tube 110. The driving element 230 is turned into rotation from translation. Due to the engagement of the first ratchet 231 with the second ratchet 241, the driving element 230 causes the collar 240 to rotate together. The lower tube 120 is rotated simultaneously. The lower tube 120 rotates the mop head 50 and the net 420. Thus, the mop head 50 is spin-dried.

Referring to FIG. 13, a cover 250 is secured to the top of the collar 240. As the driving element 230 is moved downwards in the collar 240, the height of the internal space of the collar 240 is larger than the height of the driving element 230 plus the height of the second ratchet 241.

When the upper tube 110 is lifted after it is pressed, the screw 220 moves the driving element 230 upwards in the collar 240 to disengage the first ratchet 231 from the second ratchet 241. As the driving element 230 is further moved upwards, its top reaches the bottom of the cover 250 and the upward movement is stopped. At this moment, the screw 220 is still moved upwards by the upper tube 110 so that the driving element 230 is turned into rotation from translation. At this moment, since the first ratchet 231 is disengaged from the second ratchet 241, the driving element 230 is still rotated in the collar 240 without rotating the lower tube 120.

Referring to FIGS. 11 and 12, a washer 221 is located on the screw 220. The washer 221 is located between the cap 210 and the cover 250 to prevent cap 210 from hitting the cover 250 and getting damaged when the upper tube 110 is pressed. A spring 222 is located between the cap 210 and the washer 221 for further buffering.

Referring to FIGS. 11 and 13, a fastener 223 is located at the bottom of the screw 220. The fastener 223 is preferably a rivet. A second washer 224 is located on the screw 220. The second washer 224 is located between the collar 240 and the fastener 223 so that the collar 240 cannot fall from a lower end of the screw 220 as the screw 220 is moved upwards.

Referring to FIG. 13, in the locking mechanism 30, a first rib 313 is formed on the internal face of the sleeve 310, which is secured to the upper tube 110. A second rib 242 is formed on an internal face of the collar 240 corresponding to the first rib 313 of the sleeve 310. The external diameter of the second rib 242 is larger than the internal diameter of the first rib 313 so that the lower tube 120 cannot be removed from the lower end of the upper tube 110.

Referring to FIG. 6, two lugs 314 are formed on the sleeve 310, with the opening 312 located between the lugs 314. The lug 314 includes a first aperture 315. The quick-release 320 includes a second aperture 323 corresponding to the first aperture 315 of the lug 314. A pin 324 is inserted in the first aperture 315 of the lug 314 and the second aperture 323 of the quick-release 320 to pivotally connect the quick-release 320 to the sleeve 310 in the opening 312 of the sleeve 310.

Figure 14:
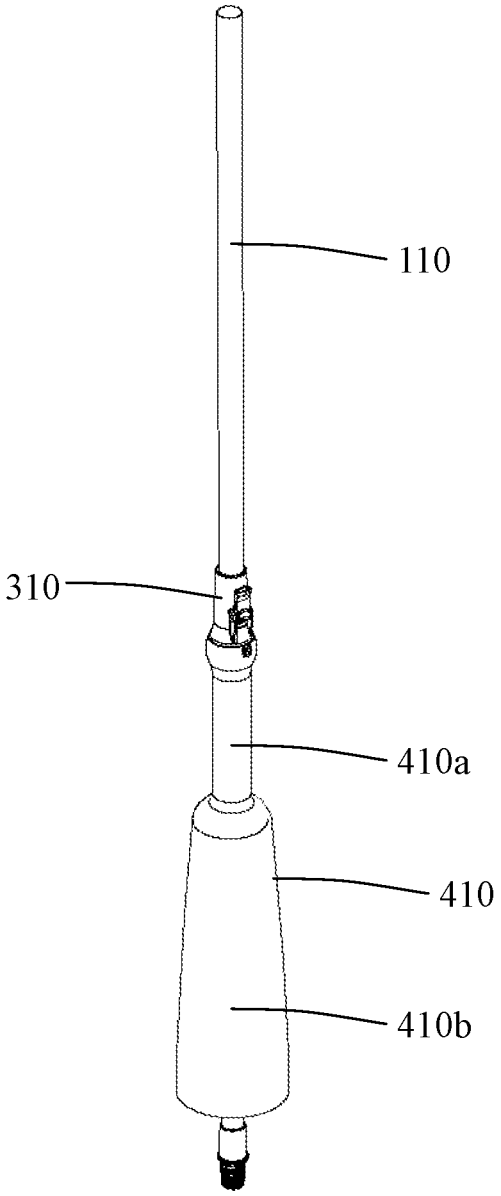
FIG. 14 is a perspective view of the spin-dryable mop illustrated in FIG. 1.
Figure 15:
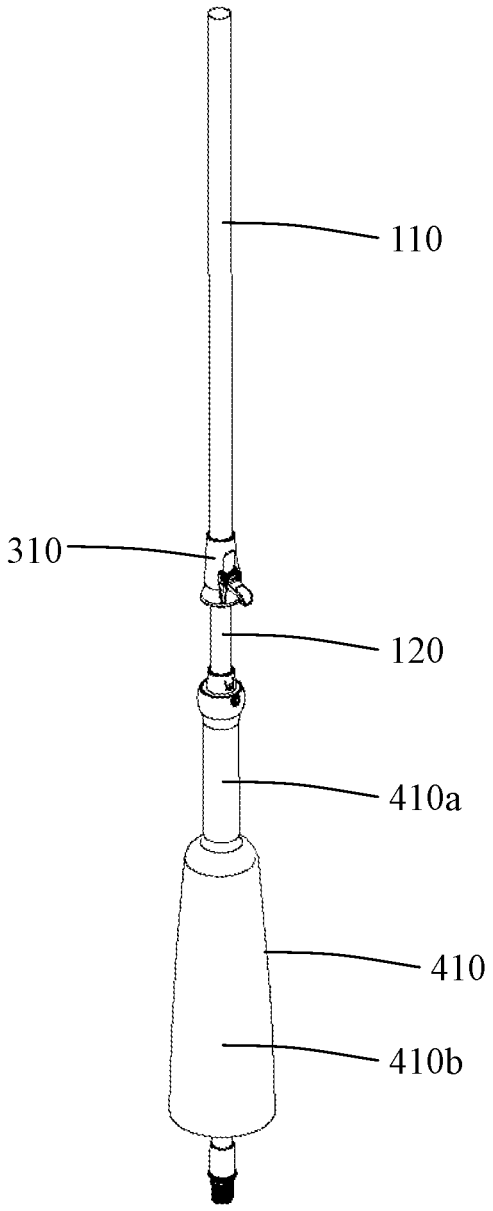
FIG. 15 is another perspective view of the spin-dryable mop in another position than shown in FIG. 14.

Referring to FIG. 5, a groove 316 is made in the wall of the cavity 311 of the sleeve 310 corresponding to the elastic block 412 formed on the engaging element 411 of the shelter 410 as shown in FIGS. 5 and 9. Referring to FIG. 10, in operation, the elastic block 412 is inserted in the groove 316 to allow engagement of the shelter 410 of the spin-drying mechanism 40 with the sleeve 310. Referring to FIGS. 5 and 14, the shelter 410 of the spin-drying mechanism 40 is engaged with the sleeve 310. Referring to FIGS. 5 and 15, the shelter 410 of the spin-drying mechanism 40 is disengaged from the sleeve 310.

Figure 16:
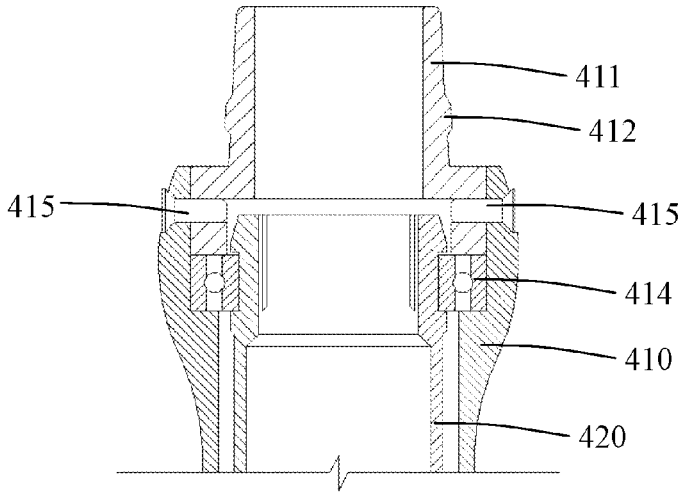
FIG. 16 is a cross-sectional view of a portion of the spin-dryable mop marked-up with "D" in FIG. 4.
Figure 17:
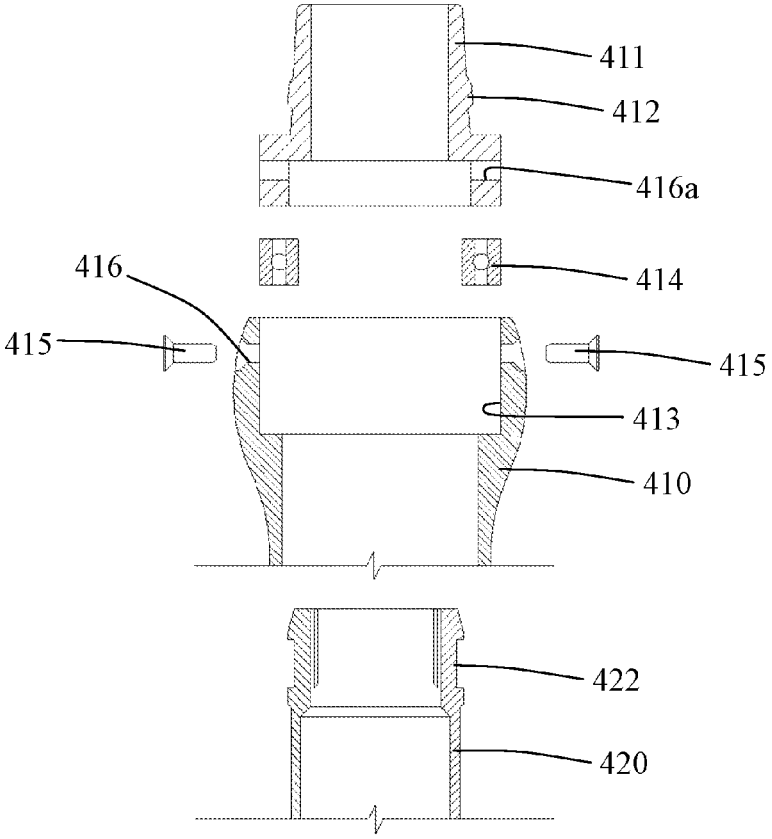
FIG. 17 is an exploded view of the spin-dryable mop illustrated in FIG. 16.

Referring to FIGS. 16 and 17, in the spin-drying mechanism 40, a cavity 413 is made in an internal face of the shelter 410. Apertures 416 are made in the periphery of the shelter 410 near the cavity 413. Apertures 416*a* are made in the periphery of the engaging element 411 of the shelter 410. A bearing 414 is inserted in the cavity 413. The engaging element 411 is pressed on the bearing 414 to fit an external ring of the bearing 414 in the cavity 413 and the engaging element 411 is secured to the shelter 410 through fasteners 415. An internal ring of the bearing 414 is located out of the cavity 413. A clip 422 is located on an external face of the net 420 corresponding to the internal ring of the bearing 414. The clip 422 is fit on the internal ring of the bearing 414. Thus, the bearing 414 is used to allow rotation of the shelter 410 relative to the net 420. Preferably, referring to FIG. 8, another bearing 414*a* is located between the shelter 410 and a lower portion of the net 420 so that the shelter 410 rotates more smoothly relative to the net 420.

To use the spin-dryable mop, the quick-release 320 of the locking mechanism 30 is maneuvered to keep the upper tube 110 in position relative to the lower tube 120. The spin-drying mechanism 40 is engaged with the upper tube 110 via the locking mechanism 30. Thus, the spin-dryable mop can be used to mop. To spin-dry the spin-dryable mop, the quick-release 320 of the locking mechanism 30 is maneuvered to allow movement of the upper tube 110 relative to the lower tube 120. The spin-drying mechanism 40 is moved downwards so that the hollow portion 420*b* of the net 420 completely covers the mop head 50. A user can use one hand to hold the grip 410*a* of the shelter 410 of the spin-drying mechanism 40 and another hand to move the upper tube 110 downwards. The lower tube 120 begins to rotate because of the spinning mechanism 20. Accordingly, the mop head 50 and the net 420 are rotated. Then, the upper tube 110 is lifted to the original position and moved downwards again. The above-discussed process is repeated so that water is cast from the mop head 50 because of the centrifugal effect. The apertures 421 of the net 420 facilitate the cast of the water that travels downwards along the internal face of the shelter 410 and falls into a bucket, a sink or any other proper place.

Referring to FIG. 2, according to the first embodiment of the present invention, the mop head 50 includes a second joint 520 and a cleaning unit 530. The second joint 520 is detachably connected to the first joint 121 of the lower tube 120. Preferably, the connection is made via engagement of threads with each other. The cleaning unit 530 is connected to the second joint 520. Preferably, the cleaning unit 530 is clothes.

Figure 4:
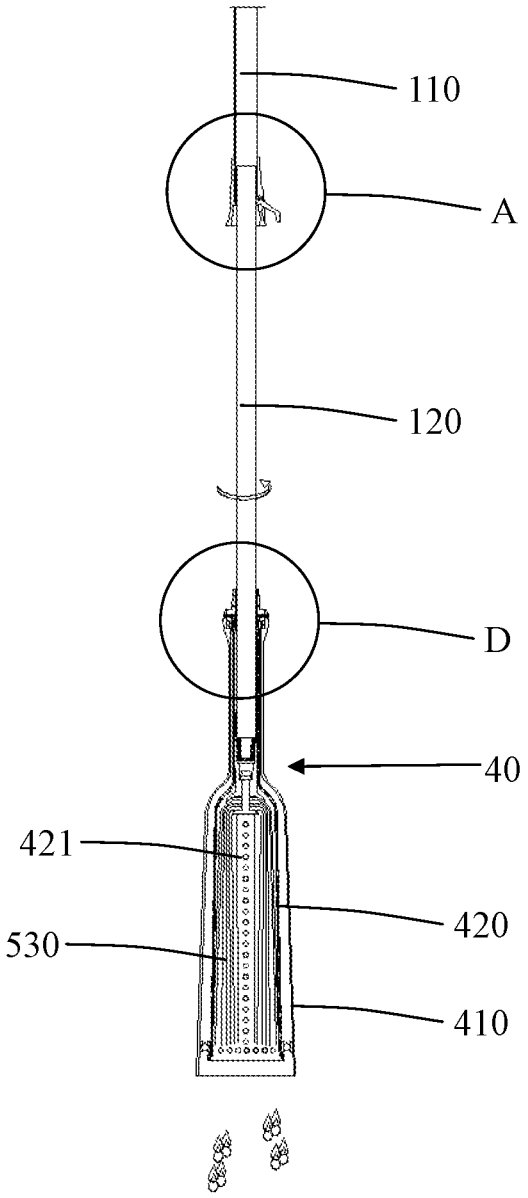
FIG. 4 is a cross-sectional view of the spin-dryable mop in another position than shown in FIG. 3.

Referring to FIGS. 3 and 4, when the spin-drying mechanism 40 is moved downwards along the lower tube 120, the cleaning unit 530 is inserted into the spin-drying mechanism 40 to be spin-dried.

Figure 18:
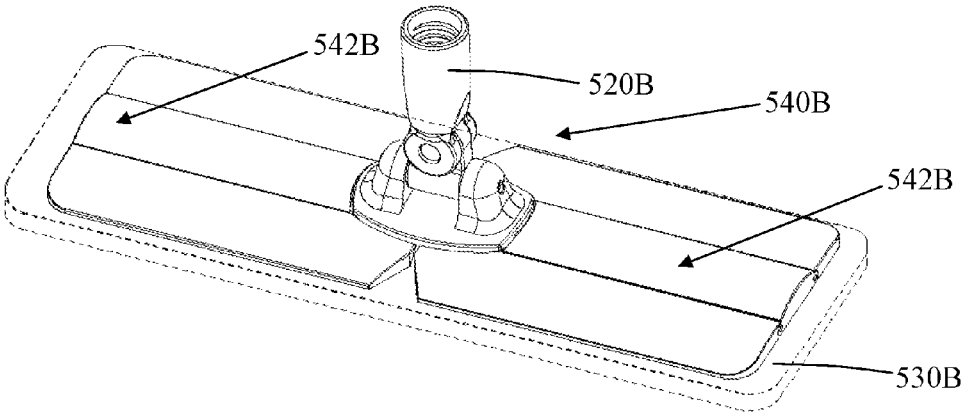
FIG. 18 is a perspective view of a mop head according to the second embodiment of the present invention.
Figure 19:
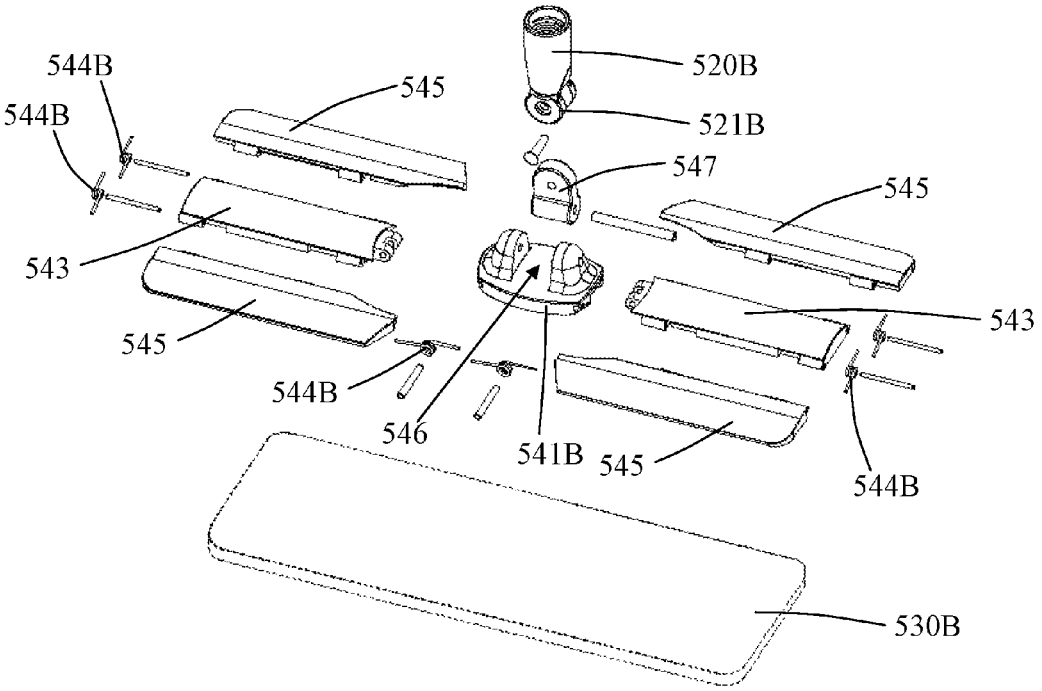
FIG. 19 is an exploded view of the mop head shown in FIG. 18.
Figure 20:
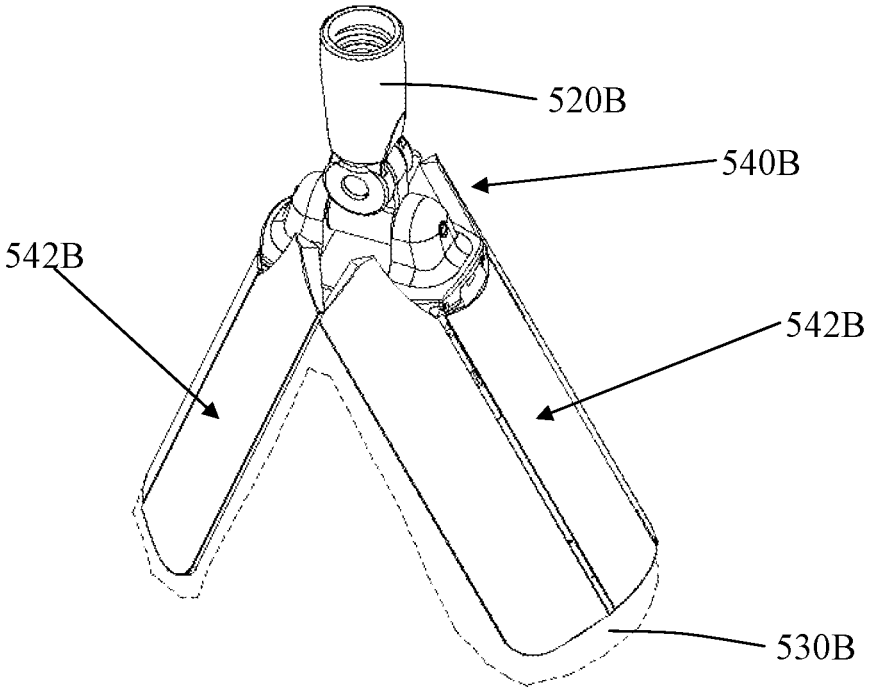
FIG. 20 is a perspective view of the mop head in another position than shown in FIG. 18.

Referring to FIGS. 18 to 20, a mop head 50B includes a connecting unit 540B and a cleaning unit 530B according to a second embodiment of the present invention.

The connecting unit 540B includes a second joint 520B and a plate 541B. Preferably, the second joint 520B is detachably connected to the first joint 121 of the lower tube 120 by threads. The plate 541B is movably connected to the second joint 520B. The plate 541B is connected to several foldable elements 542B in a collapsible manner. The foldable elements 542B are evenly distributed around the plate 541B. Preferably, there are two foldable elements 542B pivotally connected to the plate 541B via hinges.

The cleaning unit 530B is connected to lower faces of the foldable elements 542B. Preferably, the cleaning unit 530B is made of sponge.

Referring to FIG. 19, each of the foldable elements 542B includes a strip 543 and two strips 545. The strip 543 is pivotally connected to the plate 541B via a hinge 544B that consists of a torque spring and a pin.

Each of the strips 545 is pivotally connected to an edge of the strip 543 via a hinge 544B. Each of the foldable elements 542B is pivotally connected to the plate 541B via a hinge.

Referring to FIG. 19, a pair of lugs 546 is formed on the top of the plate 541B. A pivotal connector 547 is pivotally connected to the pair of lugs 546 about a first axis. A pair of lugs 521B is formed on the bottom of the second joint 520B. The pair of lugs 521B is pivotally connected to the pivotal connector 547 about a second axis extending parallel to the first axis. Hence, a universal joint is made between the second joint 520B and the plate 541B so that the plate 541B can be rotated in all directions relative to the second joint 520B.

Figure 21:
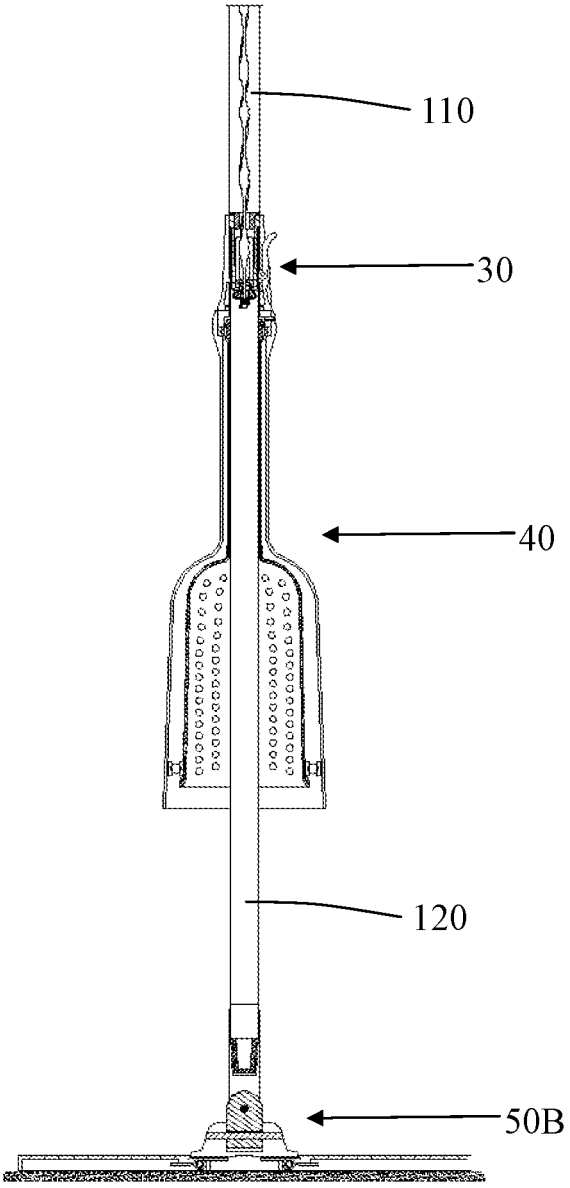
FIG. 21 is a cross-sectional view of a spin-dryable mop including the mop head shown in FIG. 18.
Figure 22:
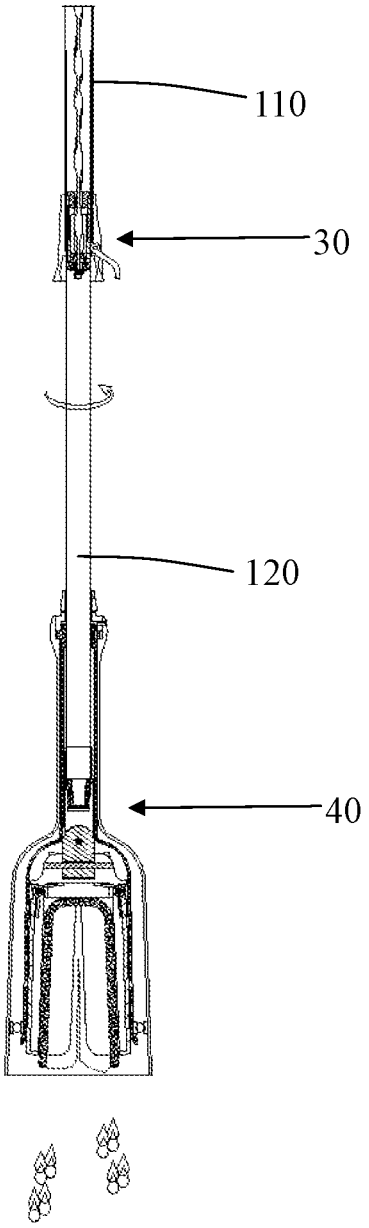
FIG. 22 is a cross-sectional view of the spin-dryable mop in another position than shown in FIG. 21.

Referring to FIG. 21, the mop head 50B is used in the spin-dryable mop. The spin-drying mechanism 40 is moved downwards to the mop head 50B along the lower tube 120. The connecting unit 540B allows the mop head 50B to collapse as shown in FIG. 20. The mop head 50B is collapsed and inserted in the spin-drying mechanism 40 as shown in FIG. 22. Now, the spin-dryable mop is ready for spin-drying.

Figure 23:
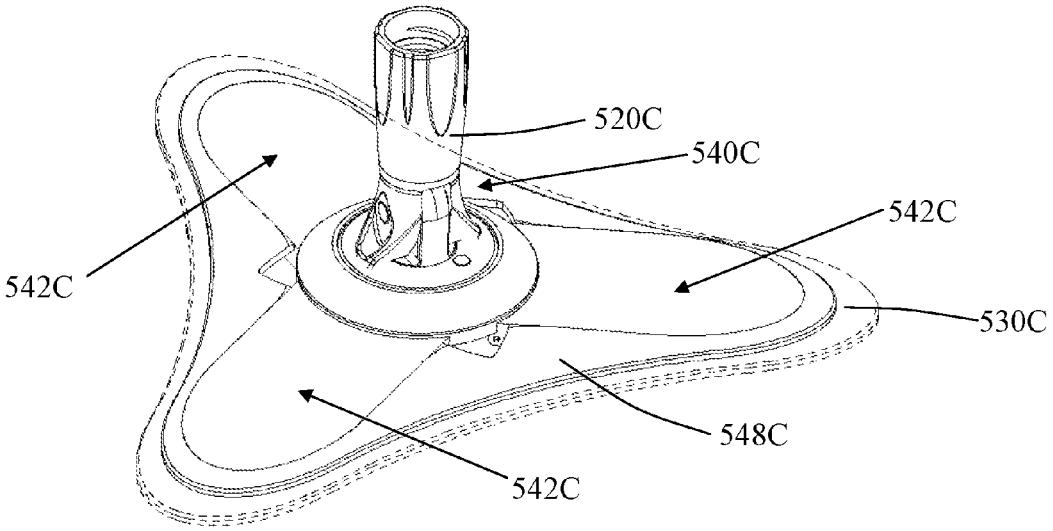
FIG. 23 is a perspective view of a mop head according to the third embodiment of the present invention.
Figure 24:
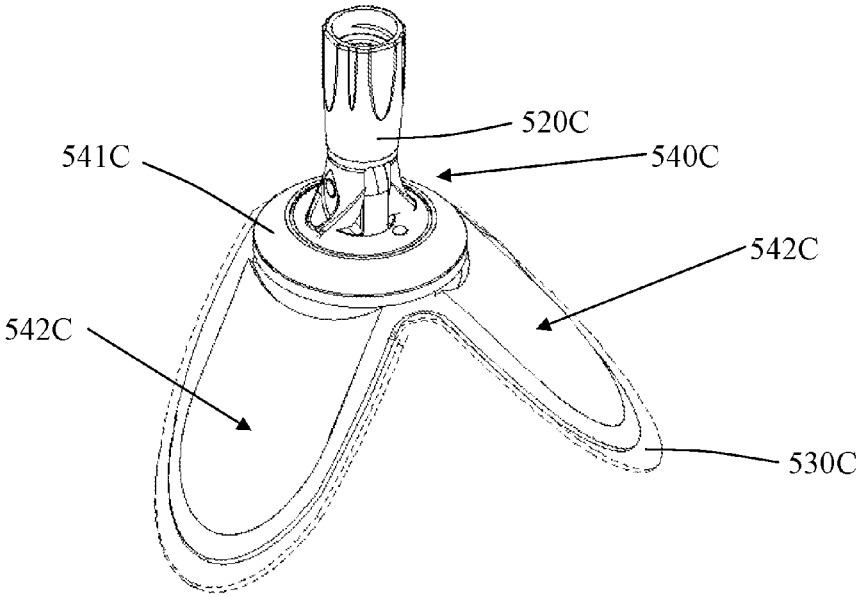
FIG. 24 is a perspective view of the mop head in another position than shown in FIG. 23.
Figure 25:
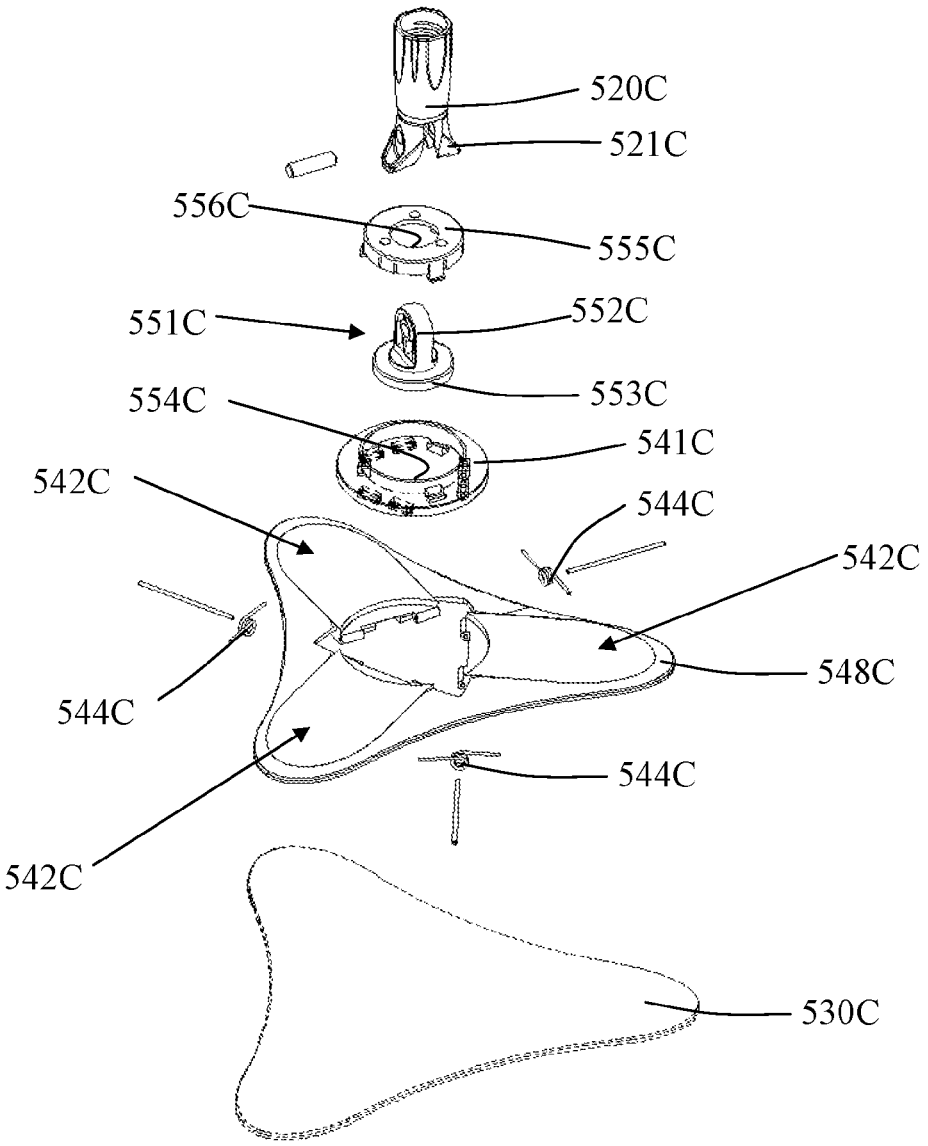
FIG. 25 is an exploded view of the mop head shown in FIG. 23.

Referring to FIGS. 23 to 25, a mop head 50C includes a connecting unit 540C and a cleaning unit 530C according to a third embodiment of the present invention.

The connecting unit 540C includes a second joint 520C and a plate 541C. Preferably, the second joint 520C is detachably connected to the first joint 121 of the lower tube 120 via threads. The plate 541C is movably connected to the second joint 520C.

The plate 541C is pivotally connected to several foldable elements 542C. The foldable elements 542C are evenly arranged about the plate 541C. A flexible strip 548C is attached to lower faces of the foldable elements 542C. Preferably, there are three foldable elements 542C. Each of the foldable elements 542C is pivotally connected to the plate 541C via a hinge 544C that consists of a torque spring and a pin.

The cleaning unit 530C is attached to a lower face of the flexible strip 548C. Preferably, the cleaning unit 530C is made of sponge.

Referring to FIG. 25, a universal joint is arranged between the plate 541C and the second joint 520C. The universal joint is movably connected to the plate 541C. The second joint 520C is pivotally connected to the universal join via a pair of lugs 521C. Hence, the plate 541C can be rotated in all directions relative to the second joint 520C because of the universal joint.

Referring to FIG. 25, the universal joint includes a pivotal element 551C and a cap 555C. The pivotal element 551C includes a lug 552C and a disc 553C. The plate 541C is made with a cavity 554C in the middle. The pivotal element 551C is movably inserted in the cavity 554C of the plate 541C.

The cap 555C is made with an aperture an aperture 556C in the middle. The cap 555C is secured to the plate 541C. The lug 552C of the pivotal element 551C extends through the aperture 556C of the cap 555C to close the 553C of the pivotal element 551C in the cavity 554C of the plate 541C.

Figure 26:
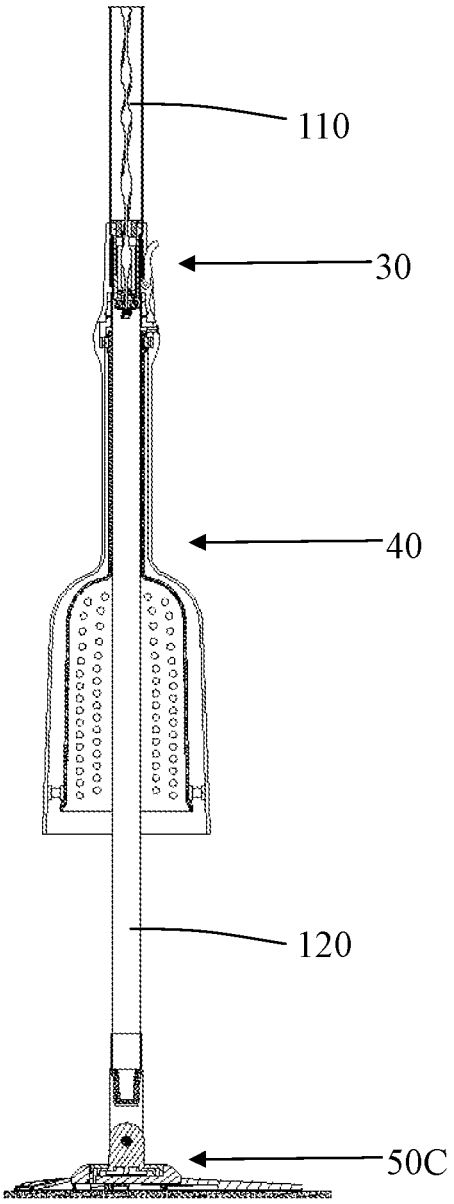
FIG. 26 is a cross-sectional view of a spin-dryable mop including the mop head shown in FIG. 23.
Figure 27:
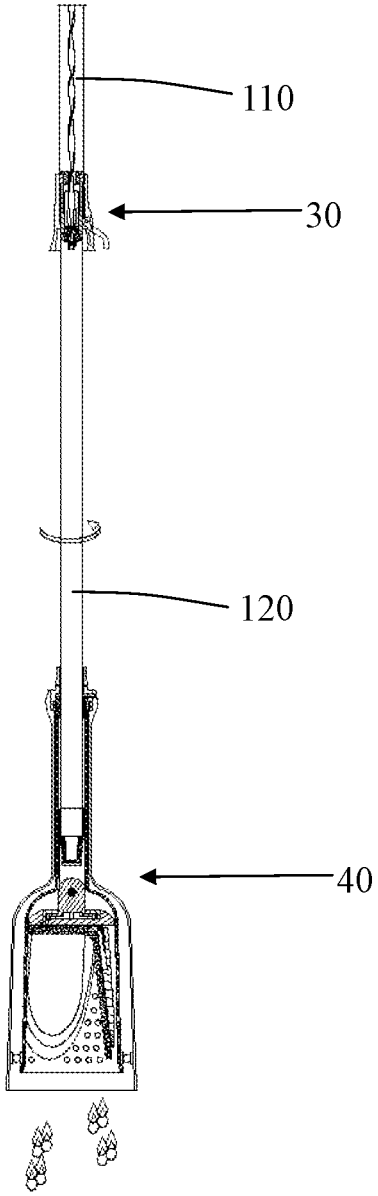
FIG. 27 is a cross-sectional view of the spin-dryable mop in another position than shown in FIG. 26.

Referring to FIG. 26, the mop head 50C is connected to the spin-dryable mop. The spin-drying mechanism 40 is moved downwards to the mop head 50C along lower tube 120. The mop head 50C is collapsed as shown in FIG. 24 because of the connecting unit 540C. Thus, the mop head 50C can be collapsed and inserted in the spin-drying mechanism 40 as shown in FIG. 27. Now, the spin-dryable mop is ready for spin-drying.

Figure 28:
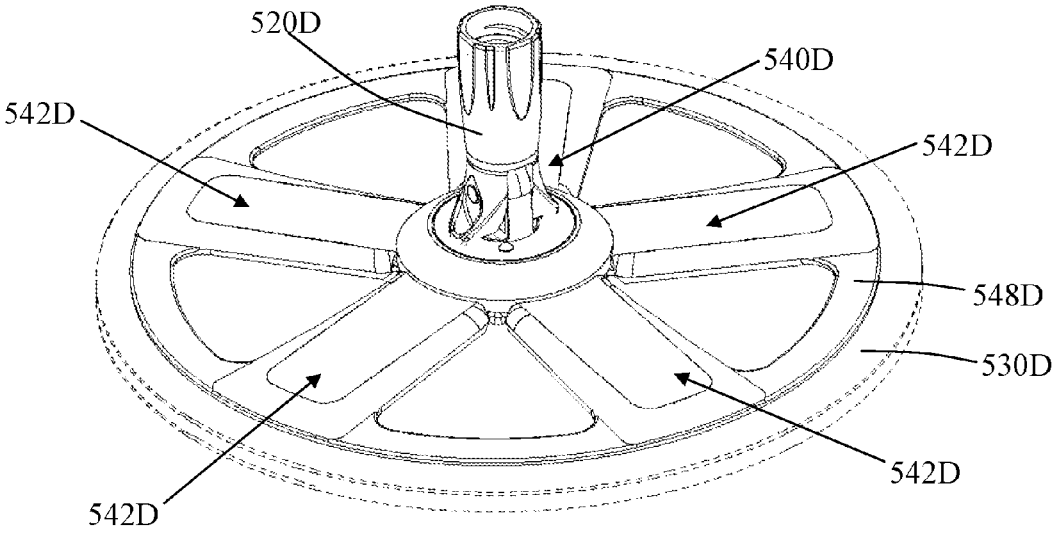
FIG. 28 is a perspective view of a mop head according to the fourth embodiment of the present invention.
Figure 29:
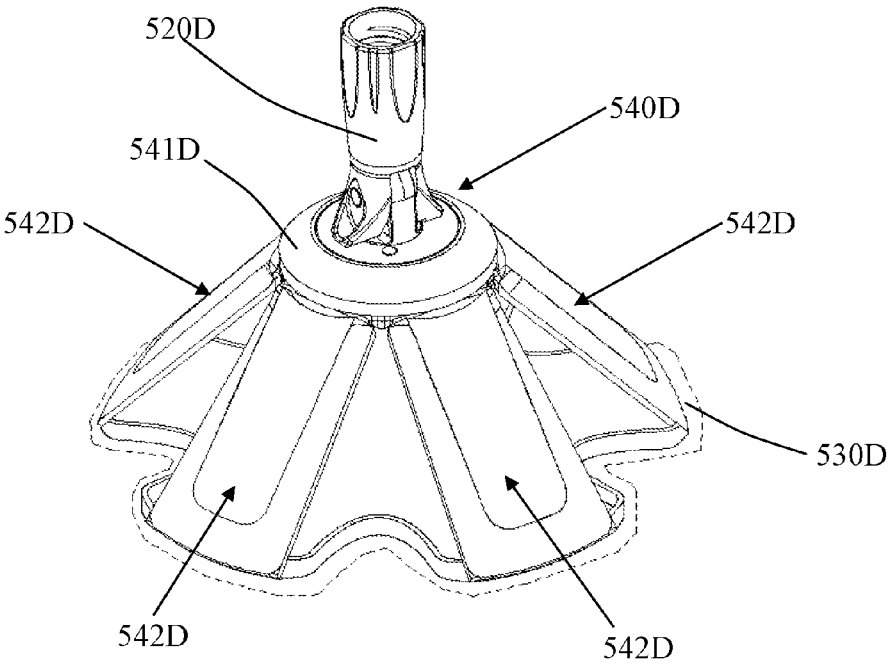
FIG. 29 is a perspective view of the mop head in another position than shown in FIG. 28.
Figure 30:
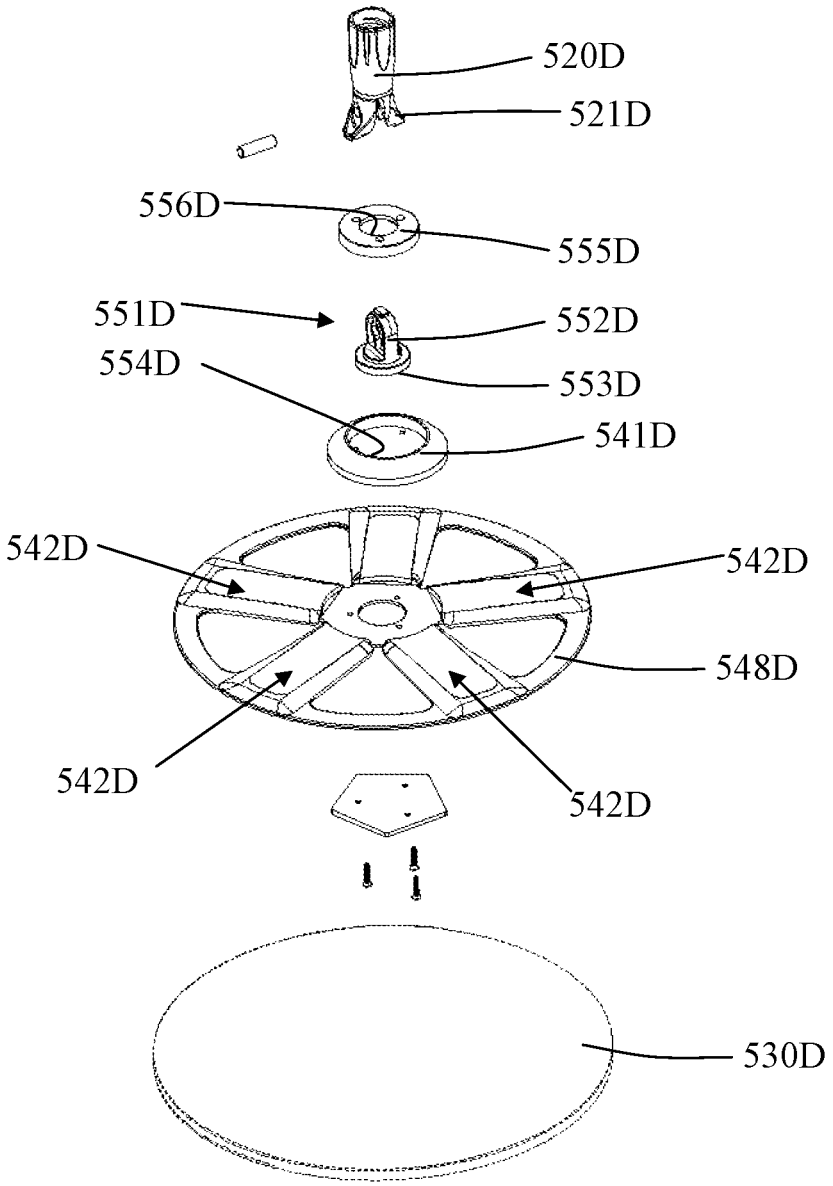
FIG. 30 is an exploded view of the mop head shown in FIG. 28.

Referring to FIGS. 28 to 30, a mop head 50D includes a connecting unit 540D and a cleaning unit 530D.

The connecting unit 540D includes a second joint 520D and a plate 541D. Preferably, the second joint 520D is detachably connected to the first joint 121 of the lower tube 120 by threads. The plate 541D is movably connected to the second joint 520D. The plate 541D is pivotally connected to several foldable elements 542D. The foldable elements 542D are evenly located around the plate 541D. Preferably, there are five foldable elements 542D that are made of a flexible material. The five foldable elements 542D together form a flexible strip 548D. The foldable elements 542D are connected to the plate 541D in a foldable manner because of its inherent properties.

The cleaning unit 530D is connected to a lower face of the flexible strip 548D. Preferably, the cleaning unit 530D is made of sponge.

Referring to FIG. 30, a universal joint is arranged between the plate 541D and the second joint 520D. The universal joint is movably connected to the plate 541D. The second joint 520D is pivotally connected to the universal joint via a pair of lugs 521D. Thus, the plate 541D can be rotated in all directions relative to the second joint 520D because of the universal joint.

Referring to FIG. 30, the universal joint includes a pivotal element 551D and a cap 555D.

The pivotal element 551D includes a lug 552D and a disc 553D. The plate 541D includes a cavity 554D made in the middle. The pivotal element 551D is movably located in the cavity 554D of the plate 541D.

The cap 555D includes an aperture 556D made in the middle. The cap 555D is secured to the plate 541D. The lug 552D of the pivotal element 551D extends through the aperture 556D of the cap 555D to close the disc 553D of the pivotal element 551D in the cavity 554D of the plate 541D.

Figure 31:
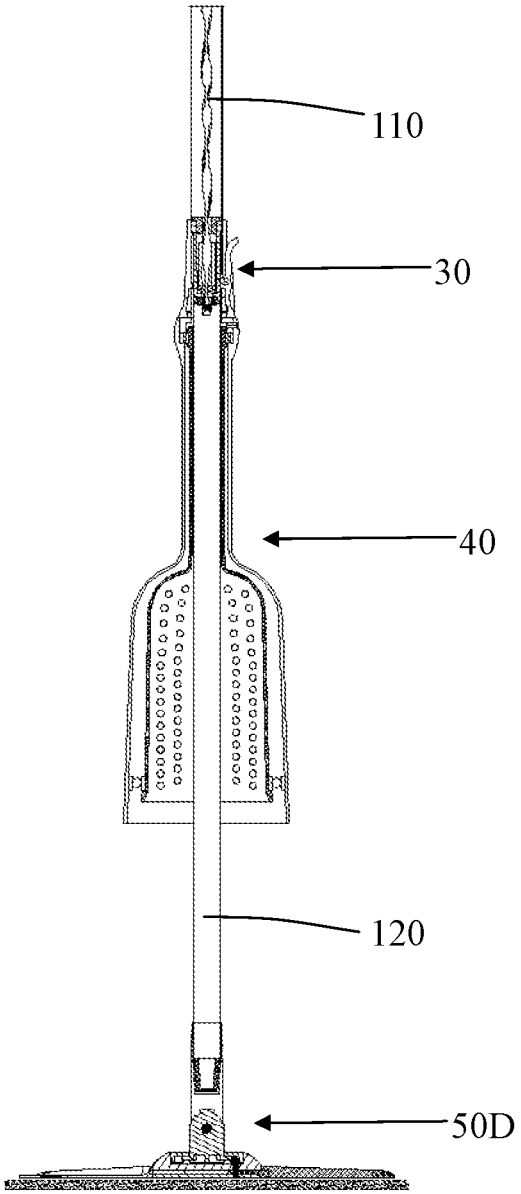
FIG. 31 is a cross-sectional view of a spin-dryable mop including the mop head shown in FIG. 28.
Figure 32:
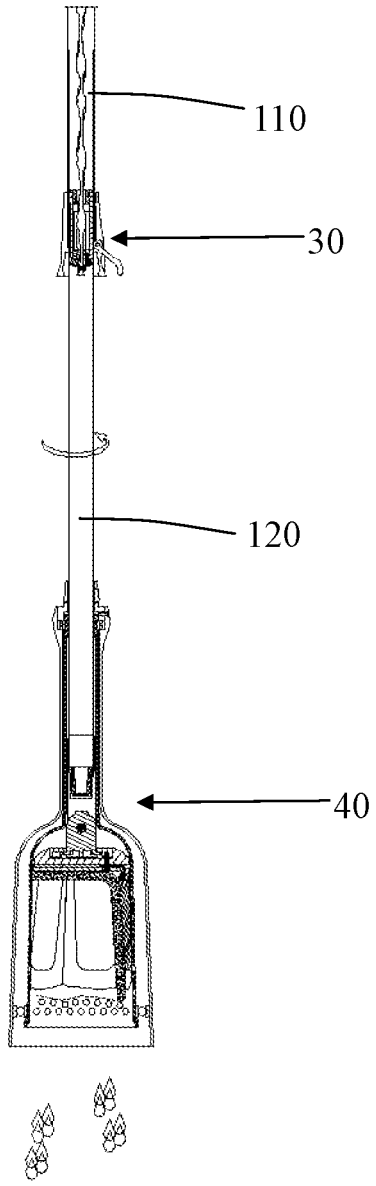
FIG. 32 is a cross-sectional view of the spin-dryable mop in another position than shown in FIG. 31.

Referring to FIG. 31, the mop head 50D is connected to the spin-dryable mop. The spin-drying mechanism 40 is moved downwards to the mop head 50D along the lower tube 120. The mop head 50D is collapsed as shown in FIG. 29 because of the connecting unit 540D. The mop head 50D is collapsed and inserted in the spin-drying mechanism 40 as shown in FIG. 32. The spin-dryable mop is ready for spin-drying.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A spin-dryable mop including:

a handle including an upper tube and a lower tube, wherein the upper tube receives the lower tube;

a spinning mechanism for movably connecting the upper tube to the lower tube, wherein the spinning mechanism rotates the upper tube relative to the lower tube when the upper tube is moved axially relative to the lower tube;

a locking mechanism including a sleeve and a quick-release, wherein the sleeve is secured to the upper tube and located at a place where the upper tube is connected to the lower tube, wherein the sleeve includes an opening, wherein the quick-release is connected to the sleeve in the opening, wherein the quick-release includes a cam extending through the opening to press the lower tube to keep the upper tube in position relative to the lower tube;

a spin-drying mechanism including a shelter and a net, wherein the net movably receives the lower tube, wherein the shelter rotationally receives the net; and a mop head connected to a lower end of the lower tube.

2. The spin-dryable mop according to claim 1, wherein the spinning mechanism includes:

a cap inserted in and secured to the upper tube;

a screw secured to a lower face of the cap;

a driving element movably receives the screw, the driving element includes a first ratchet at a lower end; and a collar inserted in and secured to the lower tube, wherein the collar includes a cavity, wherein the driving element is inserted in the cavity, wherein the screw extends through the collar, wherein the collar includes a second ratchet corresponding to the first ratchet.

3. The spin-dryable mop according to claim 2, further including a cover attached to an upper face of the collar, wherein the height of the cavity is larger than the height of the driving element plus the height of the second ratchet.

4. The spin-dryable mop according to claim 3, further including a first washer located on the screw, wherein the first washer is located between the cap and the collar.

5. The spin-dryable mop according to claim 4, further including a spring located between the cap and the first washer.

6. The spin-dryable mop according to claim 2, further including a fastener secured to a lower end of the screw and a second washer located on the screw, wherein the second washer is located between the collar and the fastener.

7. The spin-dryable mop according to claim 2, wherein the sleeve includes a first rib formed on an internal face, wherein the collar includes a second rib corresponding to the first rib, wherein the second rib is made with an external diameter larger than an internal diameter of the first rib.

8. The spin-dryable mop according to claim 1, wherein the sleeve includes two lugs so that the opening is located between the lugs, wherein each lug includes a first aperture, wherein the quick-release includes a second aperture corresponding to the first aperture, wherein a pin is inserted in the first aperture and the second aperture to pivotally connect the quick-release to the sleeve.

9. The spin-dryable mop according to claim 1, wherein the cam is formed at an end of the quick-release, wherein the quick-release includes a lever formed at another end.

10. The spin-dryable mop according to claim 1, wherein the sleeve includes a cavity, wherein the shelter includes an engaging element inserted in the cavity when the spin-dryable mop is in use.

11. The spin-dryable mop according to claim 10, wherein the sleeve further includes a groove in communication with the cavity, wherein the engaging element includes an elastic block inserted in the groove when the spin-dryable mop is in use.

12. The spin-dryable mop according to claim 1, further including a bearing and a clip, wherein the shelter includes a cavity for receiving the bearing, wherein the bearing includes an external ring inserted in the cavity and an internal ring extending out of the cavity, wherein the clip is located on the net corresponding to the internal ring of the bearing, wherein the clip is engaged with the internal ring of the bearing.

13. The spin-dryable mop according to claim 1, wherein the shelter and the net are in the form of a trumpet including a smaller upper end and a larger lower end, wherein the shelter and the net are hollow from the upper end to the lower end.

14. The spin-dryable mop according to claim 13, wherein each of the shelter and the net includes a grip and a hollow portion, wherein the grip is connected to an upper end of the hollow portion.

15. The spin-dryable mop according to claim 1, wherein the net includes a plurality of apertures.

16. The spin-dryable mop according to claim 1, wherein the mop head includes:

a joint detachably connected to a lower end of the lower tube; and a cleaning unit connected to the joint.

17. The spin-dryable mop according to claim 16, wherein the cleaning unit includes cloth.

18. The spin-dryable mop according to claim 1, wherein the mop head includes a connecting unit including a joint, a plate and several foldable elements, wherein the joint is detachably connected to a lower end of the lower tube, wherein the plate is movably connected to the joint, wherein the foldable elements are pivotally connected to the plate, wherein the foldable elements are evenly located around the plate; and a cleaning unit attached to lower faces of the foldable elements.

19. The spin-dryable mop according to claim 18, wherein each foldable element is pivotally connected to the plate via a hinge.

20. The spin-dryable mop according to claim 19, wherein the amount of the foldable elements is two.

21. The spin-dryable mop according to claim 20, wherein each foldable element includes:

a first strip pivotally connected to the plate via a hinge; and two second strips each pivotally connected to a corresponding edge of the first strip via a hinge.

22. The spin-dryable mop according to claim 20, further including a pivotal connector, wherein the plate is formed with a first lug pivotally connected to the pivotal connector about a first axis, wherein the joint is formed with a second lug pivotally connected to the pivotal connector about a second axis extending perpendicular to the first axis.

23. The spin-dryable mop according to claim 19, wherein the amount of the foldable elements is three.

24. The spin-dryable mop according to claim 23, further including a flexible strip connected to lower faces of the foldable elements, wherein the cleaning unit is connected to a lower face of the flexible strip.

25. The spin-dryable mop according to claim 23, further including a universal joint arranged between the plate and the joint, the universal joint includes:

a pivotal element including a lug and a disc, wherein the plate includes a cavity, wherein the pivotal element is movably inserted in the cavity; and a cap including an aperture, wherein the cap is secured to the plate, wherein the lug extends through the aperture to close the disc in the cavity.

26. The spin-dryable mop according to claim 18, wherein the foldable elements are made of a flexible material, wherein the foldable elements together form a flexible strip, wherein the cleaning unit is connected to a lower face of the flexible strip.

27. The spin-dryable mop according to claim 26, wherein the amount of the foldable elements is five.

28. The spin-dryable mop according to claim 27, further including a universal joint arranged between the plate and the joint, wherein the universal joint includes:

a pivotal element including a lug and a disc, wherein the plate includes a cavity, wherein the pivotal element is movably inserted in the cavity; and a cap including an aperture, wherein the cap is secured to the plate, wherein the lug extends through the aperture to close the disc in the cavity.

29. The spin-dryable mop according to claim 18, wherein the cleaning unit includes sponge.

* * * * *